United States Patent [19]

Weber

[11] Patent Number: 4,747,234

[45] Date of Patent: May 31, 1988

[54] APPARATUS FOR FINE-MACHINING CRANKSHAFT PINS

[75] Inventor: Wilfried Weber, Mossingen, Fed. Rep. of Germany

[73] Assignee: Maschinenbau Grieshaber GmbH & Co., Wolfach, Fed. Rep. of Germany

[21] Appl. No.: 911,774

[22] Filed: Sep. 26, 1986

[30] Foreign Application Priority Data

Jun. 20, 1986 [DE] Fed. Rep. of Germany ..... 8616462

[51] Int. Cl.[4] ..... B24B 5/00

[52] U.S. Cl. ..... 51/154; 51/161; 51/238 S

[58] Field of Search ..... 51/151, 154, 157, 161, 51/238 S

[56] References Cited

U.S. PATENT DOCUMENTS

| | | | |
|---|---|---|---|
| 1,908,048 | 5/1933 | Player et al. | 51/151 |
| 1,993,543 | 3/1935 | Egger | 51/154 |
| 2,270,522 | 1/1942 | Haeger et al. | 51/154 |
| 4,209,949 | 7/1980 | Staats et al. | 51/151 |

*Primary Examiner*—Frederick R. Schmidt
*Assistant Examiner*—L. Cruz
*Attorney, Agent, or Firm*—Dennison, Meserole, Pollack & Scheiner

[57] ABSTRACT

The pins of rotating crankshafts are fine-machined by resiliently biasing the workpiece towards a grinding device with a predetermined force.

6 Claims, 4 Drawing Sheets

APPARATUS FOR FINE-MACHINING CRANKSHAFT PINS

BACKGROUND OF THE INVENTION

This invention relates to an apparatus for machining the pins of a crankshaft by means of non-rotating tools.

An apparatus of this type has already been disclosed in German Offenlegungsschrift No. 34 40 350, wherein the bearings of a crankshaft are machined by means of honing stones. To machine the crankpins of the crankshaft, honing stones are arranged on two forked levers which can be brought by a bell crank lever mechanism into an opening position and a working position. The forked levers each show a guide shoe on the sides thereof facing the crankpins. In the working position of the forked levers, the crankpin is carried by the guide shoes being pressed against a cylinder jacket surface of the crankpin. The honing stones are disposed in tool carriers each movably carried on a forked lever and able to be pressed by an operating cylinder against the cylinder jacket surface of the crankpin. At machining, the arrangement by which the forked levers are supported must follow the crankpins in their connecting rod-like movements. For this purpose, the crankpins are swingably mounted on a bearing disposed at the machine stand and carry a linear-guided carriage on which the forked levers are guided.

To machine crankshaft pins, it also is known to use machines where the pins are machined by endless sanding belts which are pressed by pressure shoes against the rotating pins. The crankshaft makes a to-and-fro movement in the axial direction. Such apparatus is described by the German Petty Patent No. 86 02 827, according to which the eccentric bearing pins are surrounded by pressure shoes which press an endless sanding belt against part of the surface of the bearing pins. The pressure shoes are mounted on a pair of forked levers which are arranged freely movable so that the pressure shoes follow the movements of the bearing pin during the crankshaft's rotation. Forged crankshafts are particularly suited for such machining.

With the aforementioned apparatuses, the honing stones or the pressure shoes, respectively, are fixed to levers of a fork-type arrangement, which are opened via a bell crank lever mechanism so as to render a change of workpiece possible. As in the case of machining crankshaft pins, all of the pins must simultaneously be machined in one working step. Hence, a number of forked levers and corresponding carriers in which the forked levers are guided, must be provided for, which number corresponds to the number of the pins. Owing to the very crowded construction, above all, of the passenger car crankshafts, there is only insufficient room for the arrangement of the forked levers. For this reason, the forked levers and their bearings must be designed in rather a narrow mode, which leads to an unsatisfactory bending resistance thereof. The bending resistance of the forked levers to be achieved is sufficient as long as only a low pressure must be exerted onto the surfaces of the pins to be machined. This is the case, for example, when smoothing surfaces already ground with which nothing but a minor abrasion of working material is connected. If, however, it is necessary to correct the form of the pins, which renders a higher abrasion of working material and regularly also a stronger pressure of the machining tools necessary, stability of the narrow forked lever mechanism does not suffice. However, a deformation of the forked levers may cause a canting of the grinding tools; that is, the honing stones, and damaging the workpiece.

SUMMARY OF THE INVENTION

It is the object of the present invention to make available an apparatus for fine-machining bearing pins which is stable even at very crowded space conditions and is suited to carry out more voluminous corrections of the forms of the pins.

In conformity with the instant invention, this problem is solved by arranging a grinding tool immovably in a carriage guided by a carrier. The carriage guides a shoe arranged opposite to the grinding tool.

DESCRIPTION OF THE PREFERRED EMBODIMENTS

Figure 1:
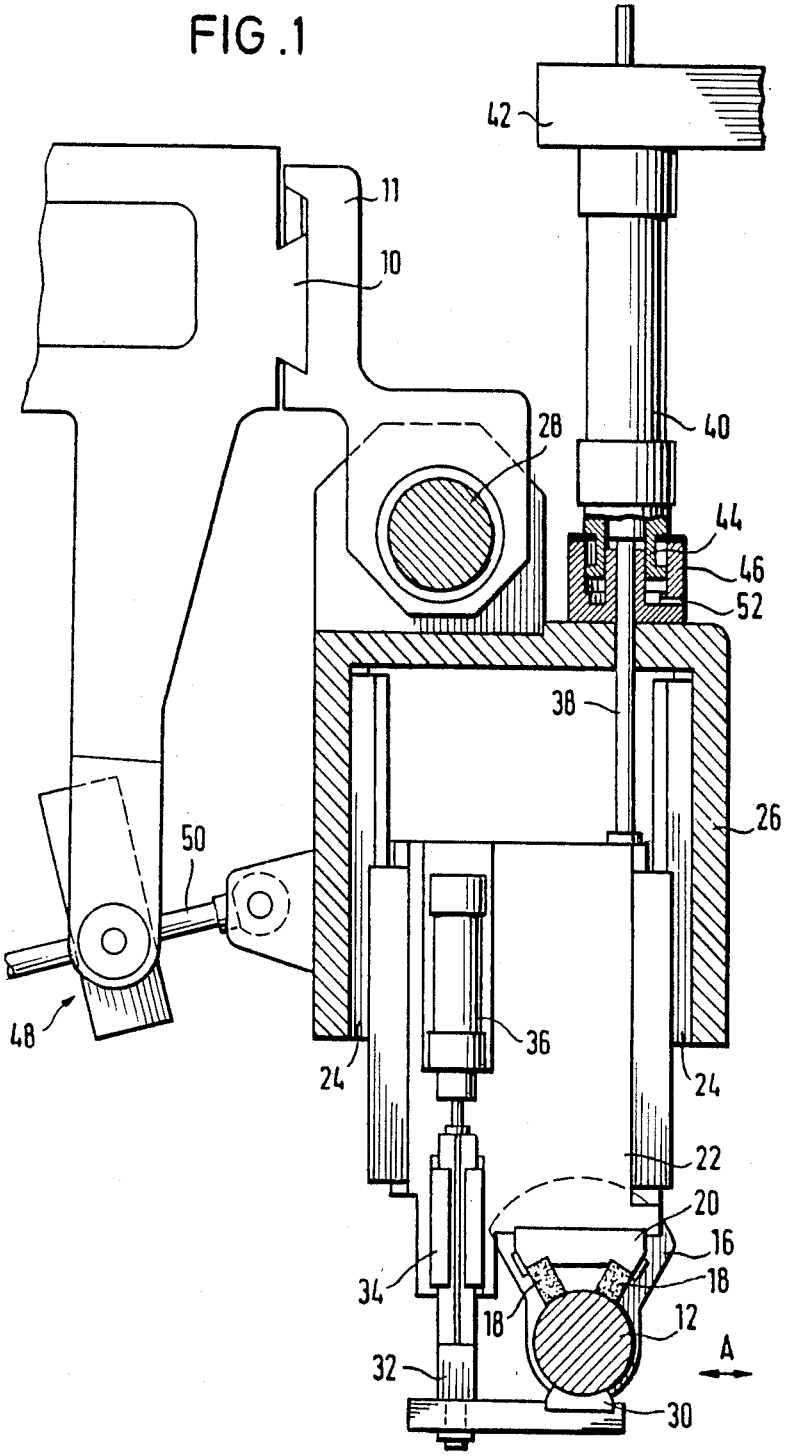
FIG. 1 shows a side elevational view, partly in section, of an apparatus for fine-machining crankshaft pins by using honing stones, according to the present invention.

An apparatus for fine-machining crankshaft pins, as illustrated in FIG. 1, contains a machine frame 10 on which arms 11 are arranged movably in the horizontal direction and fixable at a desired point. The number of arms 11 corresponds to a number of crankpins 12 to be machined on a crankshaft 16. The other members, which are described more extensively hereinafter, and are connected with arms 11, are connected with each crankpin 12 as well.

A carrier 26 is swingably supported close to its upper end on each of the horizontally extending arms 11 through an axle 28. Carrier 26 has a downwardly open recess whose lateral walls are formed as guides 24 for carriage 22. Carriage 22 is thus arranged in carrier 26 and movable in the longitudinal direction. On the side of carriage 22, which is not enclosed by carrier 26, there is mounted a replaceable holding means 20 which serves to receive two honing stones 18, and thus honing stones 18 are rigidly arranged as against the carriage. In an embodiment which is not shown, the honing stones 18 can be supported in the holder 20 by means of little springs such that they are fixed substantially rigidly as against carriage 22, but that they are nonetheless axially movable in holding means 20 within a small clearance.

Holder 32, carrying an exchangeable shoe 30 at one end, is guided in carriage 22 by guides 34. The shoe 30 is arranged opposite to the honing stones 18 in such a manner that the pin 12 to be machined is enclosed. With the other end thereof, holder 32 is connected to a pressure cylinder 36 for movement thereby.

Through a piston rod 38, carriage 22 is connected with cylinder 40 which is acted upon by compressed air or other suitable fluid through a fine-regulating valve (not shown) so as to essentially balance the dead weight of carriage 22. Cylinder 40 is carried on piston 44 which is movably disposed in lifting cylinder 46. Piston rod 38 of cylinder 40 is fed through the upper cylinder cover and penetrates a stop 42 by which carriage 22 can be fixed in a predetermined position.

The whole carrier 26 can be fixed by a rod 50 connecting it to fixing clamp 48 provided for on machine frame 10.

As illustrated in FIG. 1, both honing stones 18 and shoe 30 rest against a pin 12 in such a manner such that the carriage 22 follows the movement of crankshaft 16 and the pin 12 is machined all over its circumference. The capacity of following of carriage 22 with respect to the crankshaft pin is guaranteed by supporting carriage 22 movably in the longitudinal or vertical direction in carrier 26, on the one hand, and the carrier 26 having freedom of rotation around axle 28. By acting upon cylinder 40 with compressed air, the dead weight of carriage 22 is balanced so as not to introduce the force of the weight of the carriage 22 through the honing stones into the pin 12 to be machined. Shoe 30 is pressed by a pressure cylinder 36 through holding means 32 against a pin 12 to cause the pressing of the honing stones 18 against the member, here a pin 121, to be machined.

Upon termination of the machining of crankshaft 16, it is stopped in a predetermined position. The carrier 26 is fixed by means of fixing clamp 48 and rod 50 to the machine frame 10, thus preventing rotation of carrier 26 around pin 28. The translation of carriage 22 in carrier 26 is achieved by guiding piston rod 38 in stop 42. Pressure cylinder 36 is acted on by fluid pressure so as to vertically and downwardly lead away shoe 30 from the machined pin 12. At the same time, lifting cylinder 44 is lifted as by a liquid under pressure in port 52 so as to lift the entire carriage 22 and thus, to move away honing stones 18 from pin 12. Carriage 22 is lifted at a rate approximately corresponding to half the lift of shoe 30 carried out simultaneously. In this position, the workpiece may be exchanged in the direction of double arrow A without any hindrance from the shoe 30 or the honing stones 18.

Figure 2:
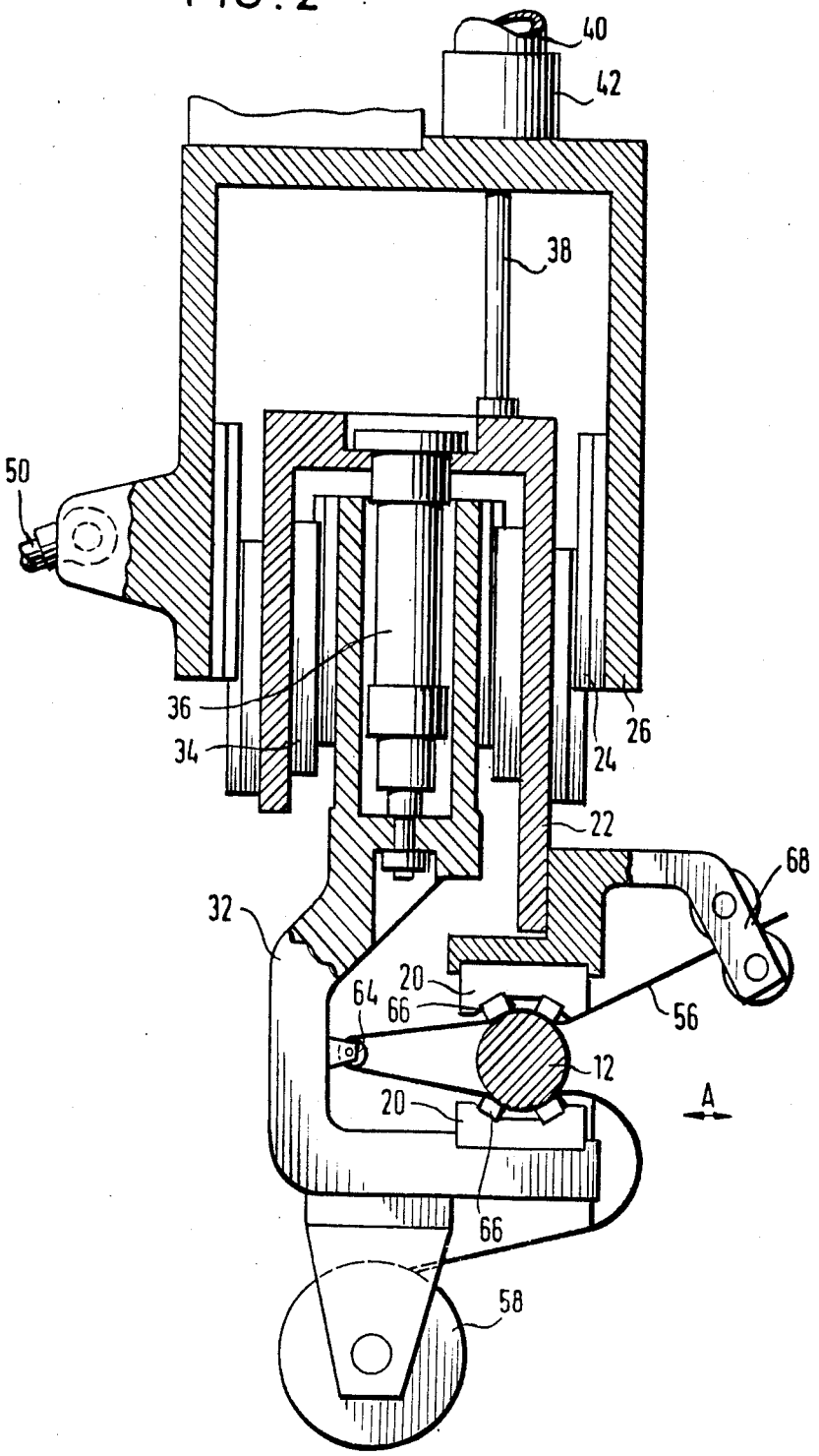
FIG. 2 is a side elevational view, partly in section, of an apparatus for fine-machining crankshaft pins by using an endless sanding belt, according to the present invention.

FIG. 2 illustrates an embodiment of the present invention where in place of honing stones 28, a sanding belt 56 in the form of a continuous web is provided for machining the respective crankshaft pin 12. The sanding belt 56 is drawn off from a supply spool 58, returned by guide roller 64 and transferred on by a switching device 68 a predetermined amount upon machining. During the machining step, the endless sanding belt is pressed by pressure shoes 66 against the surface of pin 12. Pressure shoes 66 each are supported by holding means 20, one holder 20 being carried on carriage 22 in a similar way as the honing stones of the example shown in FIG. 1, and the second holder 20 being mounted on holding means 32 in place of shoe 30 in the embodiment shown in FIG. 1. The pressing force of endless sanding belt 56 necessary for machining is introduced through holder 32 which is pressed via pressure cylinder 36. The course of motion of pressure shoes 66 for releasing machined pin 12 for the exchange of workpiece corresponds to that of the embodiment illustrated in FIG. 2, where honing stones 28 and shoe 30 release pin 12. Upon release and drive-out of machined pin 12, the endless sanding belt 56 is transferred on by the switching device 68, mounted on carrier 22, a predetermined length so as to place a new length of sanding belt 56 at the disposal of the successive machining step.

Figure 3:
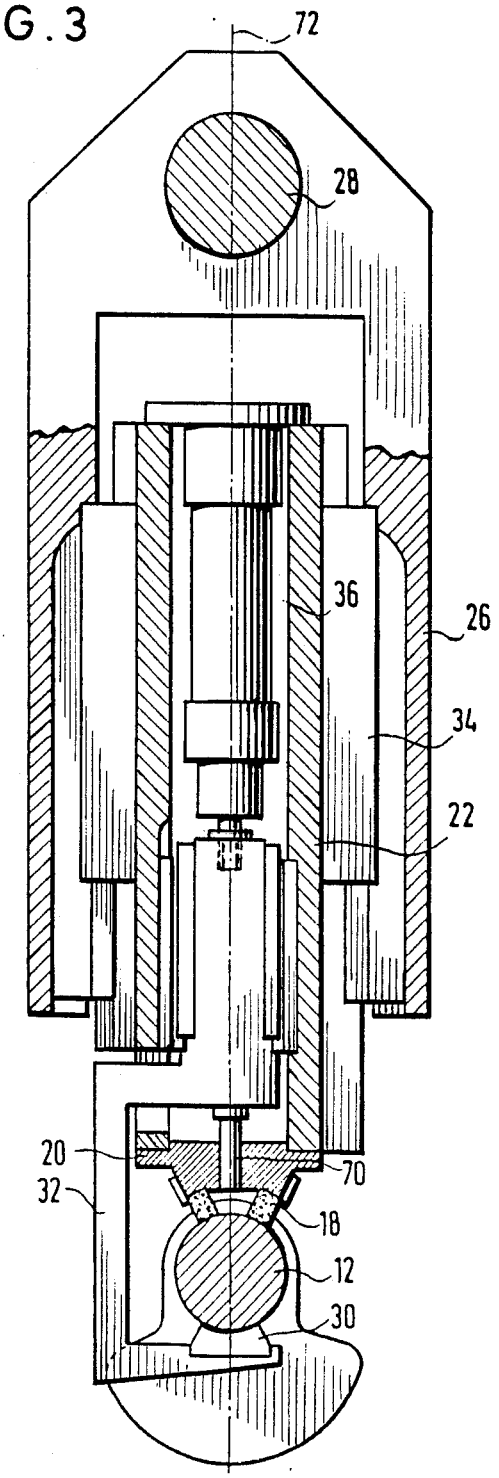
FIG. 3 is a side elevational view, partly in section, of still another embodiment of an apparatus for fine-machining crankshaft pins, according to the present invention.

In the preferred embodiment shown in FIG. 3, there is also guided a carriage 22 by a guide 34 provided in a carrier 26 and this axially movable carrier 26 pivotally positioned on a pin 28 at a center line 72. Pressure cylinder 36, which is followed by a holder 32 to receive a shoe 30, is suspended in carriage 22 aligned symmetrically with center line 72. Here, holder 32 is guided laterally out of carriage 22, and has a U-shaped cross section so as to press shoe 30 against pin 12 from below. Two honing stones 18 are carried on carriage 22 through guide 20 and also are arranged symmetrically to center line 72. Thus, honing stones 18, on the one hand, and pressure shoe 30, on the other, each are arranged symmetrically to center line 72, and are disposed facing each other.

As a departure from the embodiments described above, in this embodiment, carriage 22 is not supported through piston rod 38 in cylinder 40. In place thereof, a spacer 70, extending also symmetrically to center line 72, is linked to holder 32 and guided through a bore provided at the end of carriage 22.

Upon termination of the machining of pin 12, holder 32 along with integrated shoe 30 is downwardly moved away by means of pressure cylinder 36. Lifting of shoe 30 is limited by the spacer 70 impinging on pin 12. If the force of pressure is increased further, the whole carriage 22, along with honing stones 18, is lifted off from the pin 12 such that after the fixation of carrier 26, the exchange of workpiece can be carried out without any hindrance.

Figure 1A:
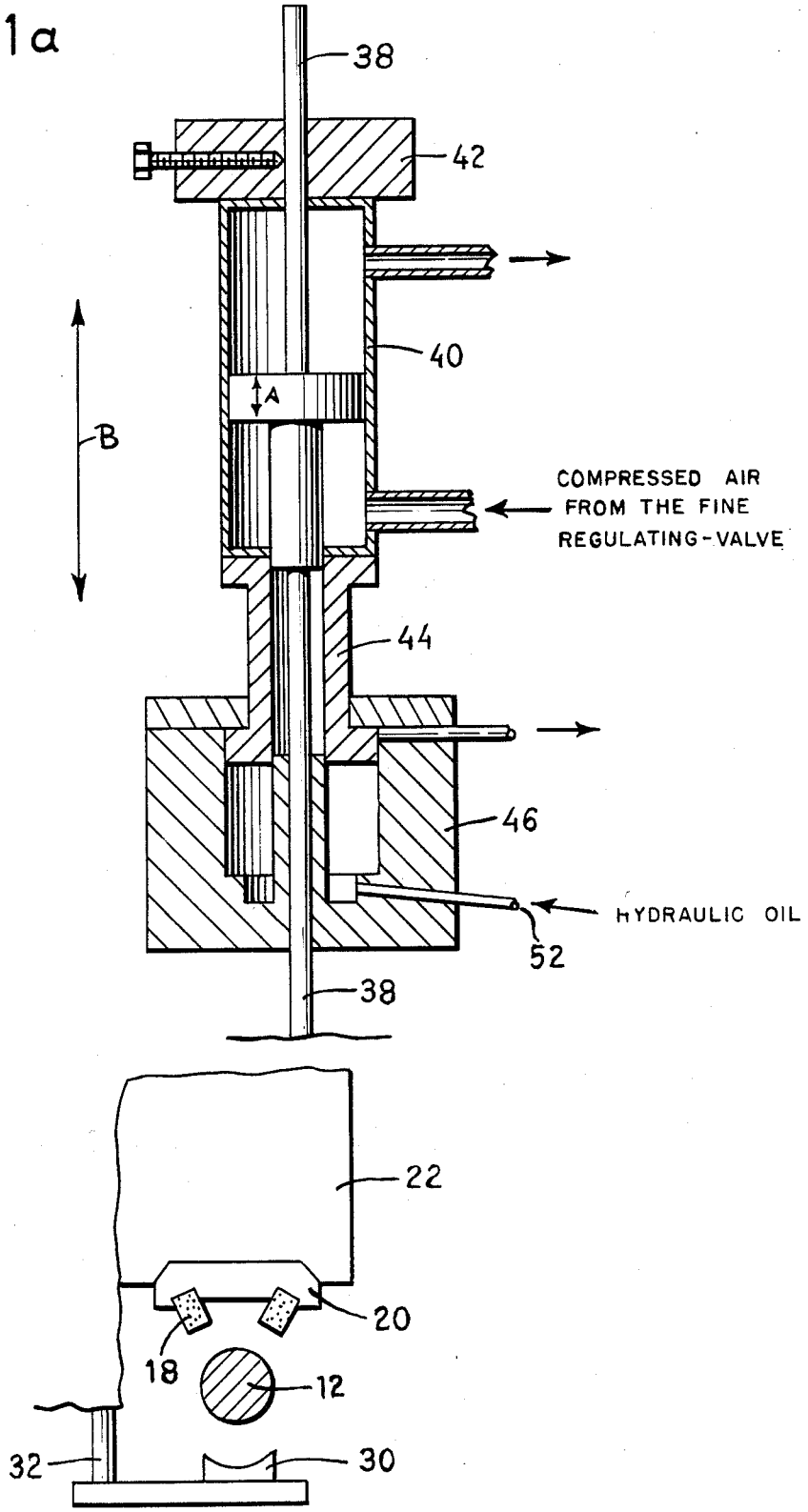

The piston-cylinder arrangement 38/40 is intended to absorb the weight of the movable carriage 22 in the carrier 26 so that this is not totally passed over to the crank-pins which are to be machined through the honing stones 18. Before the pins are machined, compressed air is fed into the hollow cylinder 40 by means of a fine-regulating valve and the piston rod 38 is thereby pushed in the direction marked in FIG. 1*a* by the arrow A until the weight of carriage 22 is counterbalanced. After the device has been set in the described manner, the piston rod 38 is then fixed in the stop 42. For example, the piston-rod may be fixed, as shown in FIG. 1*a*, by means of a screw. So that the total weight of the carriage 22 is not passed over to the pin 12 and that, at the same time, the necessary force for machining is reached, the pressure cylinder 36 pushes against the exchangeable shoe 30, thereby regulating the pressure of the shoe. It is important to notice that the adjusting device 42 is not fixed to an outer casing but matches the axial movements of the cylinder 40, as indicated by the double-ended arrow B in FIG. 1*a*.

FIG. 1 shows the grinding device during the process of machining the crank-pin 12. FIG. 1*a* shows the same apparatus at a point where the crank-pin may be exchanged for another crank-pin which is to be machined. In order to do this, hydraulic oil is pumped into the main cylinder 46 through the opening 52 and the hollow piston 44 and the whole arrangement, which is composed of the piston rod 38 and the carriage 22 which is connected to it, is pushed upwards. The honing stones 18 are picked up by the machined pin while at the same time, the shoe 30 is moved away from the crank-pin by the pressure cylinder 36, so that the crank-pin may be freely moved and taken out and replaced with a new one.

When the new crank-pin is in place, the hydraulic oil is let out of the opening marked 52, the lifting cylinder 44 sinks back into cylinder 46, and the honing stones touch the crank-pin which is to be ground. At the same time, shoe 30 is brought into its working position on the crank-pin by means of the cylinder 36.

I claim:

1. Apparatus for fine-machining the pins of rotating crankshafts and the like comprising, in combination:

(a) grinding means arranged for engaging a workpiece to be machined; and (b) biasing means arranged engaging the workpiece in an area opposite engagement of the workpiece by the grinding means for creating a predetermined force between the grinding means and the workpiece to be machined, said biasing including:

(1) carrier means for supporting the grinding means;

(2) carriage means mounted on the carrier means for sliding movement toward and away from a workpiece to be machined;

(3) shoe means mounted in the carriage means for movement therethrough and arrangeable biasingly engaging a workpiece to be machined;

said biasing means further including holder means fixed to the carriage means; and fluid motor means mounted on the carrier means and connected to the carriage means for moving the carriage means toward and away from a workpiece to be machined.

2. Apparatus as defined in claim 1, wherein the fluid motor means includes a lifting cylinder mounted on the carrier means, a piston slidably movable in the lifting cylinder, and a cushioning cylinder mounted on the piston for movement thereby.

3. Apparatus as defined in claim 2, wherein the fluid motor means further includes a piston rod arranged mounted on the piston for movement therewith and connected to the carriage and extending through the cylinder, and stop means disposed above the cylinder for fixing movement of same.

4. Apparatus as defined in claim 1, wherein the grinding means includes an endless belt disposed contacting opposed surface areas of a workpiece to be machined.

5. Apparatus as defined in claim 4, wherein the biasing means includes shoe means for pressing the endless belt against the opposed surface areas of a workpiece to be machined.

6. Apparatus as defined in claim 4, further including a machine frame, and wherein the carrier means is pivotally mounted on a machine frame, and clamp means for fixing the carrier means in a desired position relative to the machine frame.

* * * * *